US006056704A

United States Patent [19]

Ide

[11] Patent Number: 6,056,704

[45] Date of Patent: May 2, 2000

[54] FOOT-PRESSURE MASSAGE STAND

[76] Inventor: Masatake Ide, 3-33-17, Shimorenjaku, Mitaka-shi, Tokyo, Japan

[21] Appl. No.: 09/302,779

[22] Filed: Apr. 30, 1999

Related U.S. Application Data

[63] Continuation of application No. 08/910,477, Jul. 25, 1997, abandoned, which is a continuation-in-part of application No. 08/381,211, Jan. 31, 1995, abandoned, which is a continuation-in-part of application No. 08/085,976, Jun. 30, 1993, abandoned.

[30] Foreign Application Priority Data

Mar. 3, 1993 [JP] Japan ..... 5-082373

[51] Int. Cl.[7] ..... A61H 1/00

[52] U.S. Cl. ..... 601/23; 52/64; 52/79.4; 52/236.1; 52/284; 601/134

[58] Field of Search ..... 128/24 R, 44, 128/59–62 R, 857; 606/201, 204, 243; 269/283, 280, 208, 244, 268, 269; 52/126.1, 126.3, 64, 65, 264, 33, 79.1, 79.5, 27, 69, 70, 79.4, 236.1, 270, 284; 160/351, 352; 135/116, 148, 149; 601/23, 134, 24, 135

[56] References Cited

U.S. PATENT DOCUMENTS 1,384,072 7/1921 Kercher .
2,204,319 6/1940 Parsons et al. .
3,279,463 10/1966 Krimmel .
3,670,750 6/1972 Johnston .
4,085,762 4/1978 O'Brian et al. .
4,161,850 7/1979 Peterson et al. .
4,295,307 10/1981 Jensen .
4,936,294 6/1990 Chu .

*Primary Examiner*—Danton D. DeMille
*Attorney, Agent, or Firm*—Morrison Law Firm

[57] ABSTRACT

A foot-pressure massage stand and method effectively massages parts of a patient's body by using foot pressure either directly upon the patient by an operator or indirectly when a patient massages himself. The foot-pressure massage stand makes it possible for an operator and a patient or a patient alone to select an appropriate width between the friction wall and the reaction wall. One disclosed method is for the patient to massage himself while sitting on the floor plate, by using various auxiliary tools to massage areas of his or her body such as the back and lateral chests. Another method involves an operator applying foot pressure to a patient permitting the force to be increased by a magnitude of ten. By exerting foot pressure using the massage stand, stronger foot pressure can be achieved than by just using body weight or by leaning against only one wall, thereby achieving a more effective massage than is possible with conventional methods.

11 Claims, 3 Drawing Sheets

FOOT-PRESSURE MASSAGE STAND

This application is a continuation application of U.S. patent application Ser. No. 08/910,477 filed Jul. 25, 1997 now abandoned, which is a continuation-in-part application of U.S. patent application Ser. No. 08/381,211 filed Jan. 31, 1995 now abandoned, which is a continuation-in-part application of U.S. patent application Ser. No. 08/085,976 filed Jun. 30, 1993 now abandoned, which claims priority to Japanese Patent Application No. 582373, filed Mar. 3, 1993, which issued as Japanese Patent No. 2614808 on Feb. 27, 1997.

BACKGROUND OF THE INVENTION

The present invention relates to foot-pressure massage stands and methods of using same. More particularly, the present invention relates to methods and apparatus for massaging using foot-pressure either directly upon a patient by an operator or indirectly when a patient massages himself.

Conventional methods of massaging with foot pressure disclose operators directly applying pressure by resting body weight on patients. Among the disadvantage of known methods are that foot pressure imparts inadequate force upon target areas to be effective. Similarly, conventional methods fail to employ alternate devices and methods to specifically direct forces to recognized target areas of the back.

Although it has been known that massaging a patient using foot pressure is an effective form of massage, the prior art does not disclose devices or methods which have been developed to apply such foot pressure to target areas effectively.

OBJECTS AND SUMMARY OF THE INVENTION

Accordingly, it is an object of the present invention to provide a method of foot-pressure massage which overcomes the drawbacks of the prior art.

A further object of the invention is to provide a method by which the operator can directly exert a stronger foot pressure upon a patient.

Still a further object of the invention is to provide a method by which a patient can indirectly exert a stronger foot-pressure upon himself or herself than is possible with conventional methods in order to provide a more effective massage.

Briefly stated, the present invention provides a foot-pressure massage stand and method which effectively massage parts of a patient's body by using foot pressure either directly upon the patient by an operator or indirectly when a patient massages himself. The foot-pressure massage stand makes it possible for an operator and a patient or a patient alone to select an appropriate width between a friction wall and a reaction wall. One disclosed method is for the patient to massage himself while sitting on a floor plate, by using various auxiliary tools to massage areas of his body such as the back and lateral chests. Another method involves an operator applying foot pressure to a patient. By exerting foot pressure using the massage stand, stronger foot pressure can be achieved by than just using body weight or by leaning against only one wall, thereby achieving a more effective message than the conventional method.

A feature of the present invention provides a method for massaging humans comprising providing a pair of opposed walls, a first wall being a friction wall and a second wall being a reaction wall, said walls including means for adjusting the space between said reaction wall and said friction wall, positioning a patient sideways against said friction wall, positioning an operator against said reaction wall opposed to said friction wall and stretching a leg of said operator to contact said patient thereby exerting foot pressure upon said patient.

A further feature of the present invention provides an apparatus for foot pressure massage comprising: a reaction wall, a friction wall, a floor plate, an auxiliary tool removably attached to one of said friction and reaction walls, said reaction wall affixed to said floor plate in a non-parallel orientation to said reaction wall, means for adjusting space between said reaction wall and friction wall, means for mounting said auxiliary tool, an inner surface of said reaction wall effective for receiving the back of an operator, an inner surface of said friction wall effective for receiving a patient, a back of said operator positioned in contact with said reaction wall, said patient oriented in at least one of a plurality of positions in contact with said friction wall, at least one foot of said operator contacting said patient in at least one of a plurality of areas with pressure generated by said operator exerting a force against said reaction wall.

The above and other objects in addition to the features and advantages of the present invention will become apparent from the following description read in conjunction with the accompanying drawings, where like reference numerals designate the same elements.

DETAILED DESCRIPTION OF THE PREFERRED EMBODIMENT

Figure 1:
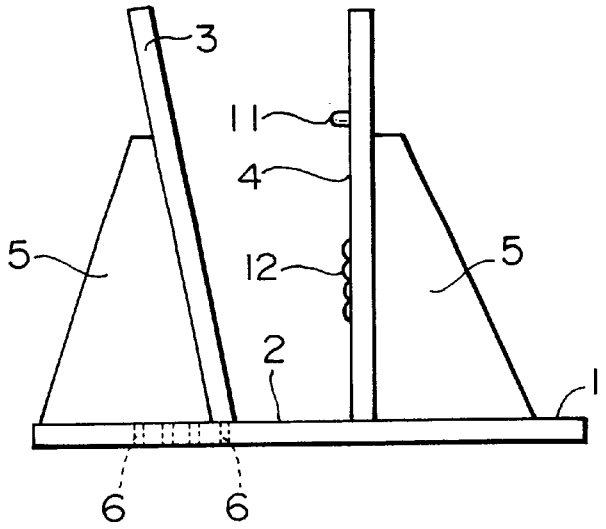
FIG. 1 is a cross-sectional side view illustrating an embodiment of the foot-pressure massage stand according to the present invention.

Referring to FIG. 1, a massage stand 1 comprises a reaction wall 3 and a friction wall 4 opposed on a floor plate 2 in a non-parallel fashion. Reaction wall 3 is also non-perpendicular to floor plate 2, while friction wall 4 is substantially perpendicular to floor plate 2. Each of said walls is supported by a stay 5 on an outer side. If either of walls 3, 4 is adequately supported or stationary, stay 5 is unnecessary. The space between reaction wall 3 and friction wall 4 may be adjusted.

Figure 2:
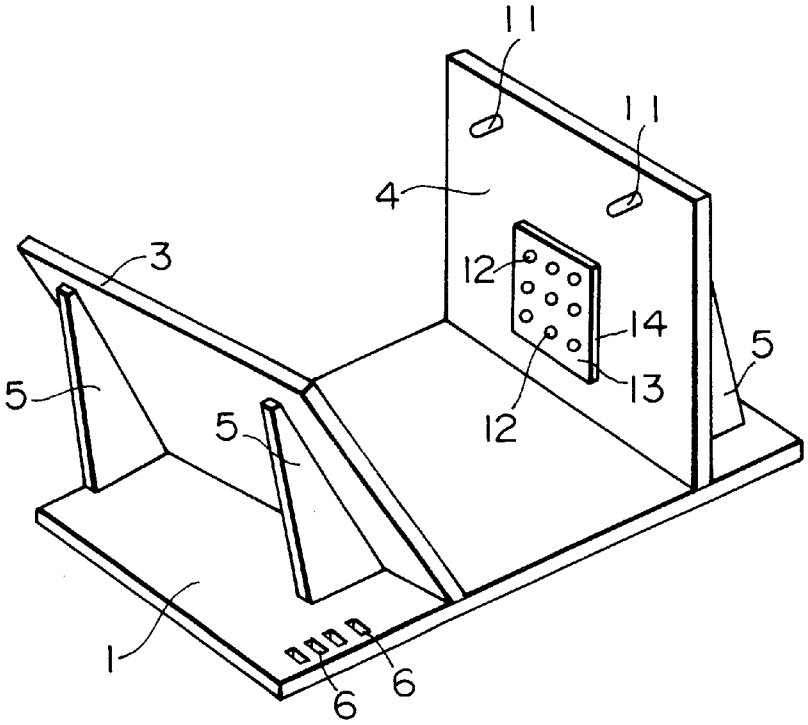
FIG. 2 is a partial perspective view of the foot-pressure massage stand of FIG. 1.
Figure 3:
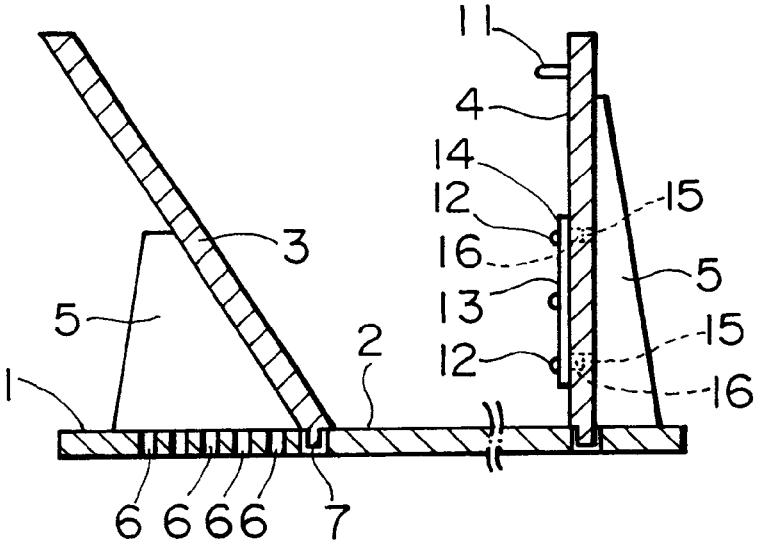
FIG. 3 is a partially expanded cross-sectional view of the foot-pressure massage stand of FIG. 1.

A variety of methods may be employed to change the width of the space between walls 3, 4. Referring now to FIGS. 1–3, pairs of adjusting holes 6 are shown to be located on floor plate 2. As shown in FIG. 3, two connecting parts 7 are attached to a bottom of reaction wall 3 and correspond to a complementary pair of adjusting holes 6, which support reaction wall 3 in an upright and stationary position. Because several pair sets of adjusting holes 6 are located upon floor plate 2, reaction wall 3 can be adjusted to widen or narrow the width of the space between walls 3, 4. It should be noted that the method of corresponding adjusting holes 6 to connecting parts 7 in order to adjust the width between walls 3, 4 can also be applied to friction wall 4 instead of or in conjunction with reaction wall 3.

Referring now to FIG. 2, an auxiliary tool 14 is attached to an inner surface of friction wall 4. It should be noted that auxiliary tool 14 can also be attached to an inner surface of reaction wall 3 or be completely eliminated because it is not a necessary component of the present invention. A handle 11, another optional feature, may be attached on friction wall 4 as shown in FIGS. 1–3, and held by a patient to support and/or stabilize his or her body during a massage.

Auxiliary tool 14 is composed of half-spherical bosses 12 formed on a base plate 13.

Referring now to FIG. 3, any type of auxiliary tool 14 can be mounted on either of walls 3, 4 by inserting four pins 16 into four attaching holes 15. It is recommended that the mounting of auxiliary tool 14 be arranged so as to be easily attached and removed so that a variety of auxiliary tools such as those described above can be readily used.

Figure 4:
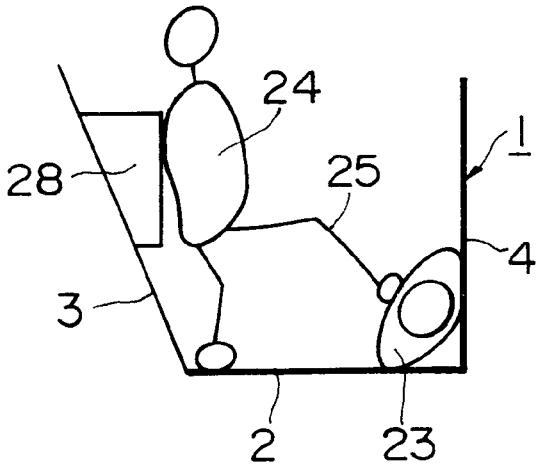
FIG. 4 is an illustration showing one method of using the present invention by massaging through applying foot pressure by an operator onto a patient.

Referring now to FIG. 4, a method of the present invention is shown. A patient 23 lies sideways against friction wall 4. An operator 24 stands while leaning against reaction wall 3 and stretches a leg 25 in order to directly exert foot pressure upon patient 23. It is noted that patient 23 may also be in other positions such as lying on a stomach or sitting against friction wall 4, as long as the body of patient 23 is stable. In this application, operator 24 can thus enhance the force applied by a leg by using the massage stand in order to provide a systematic massage to patient 23 in a fast or slow motion and at a desired strength. Force applied according to the present invention is increased by a factor of ten, allowing for an effective method of massage heretofore undisclosed.

Figure 5:
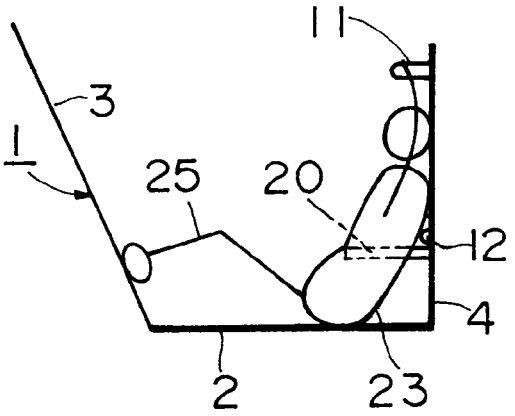
FIG. 5 is an illustration showing another method of using the present invention by the patient massaging himself.

Referring now to FIG. 5, a further method according to the present invention is shown when patient 23 massages himself or herself using massage stand 1 without operator 24. Patient 23 in FIG. 5 can massage his or her own back with indirect foot pressure while in a sitting position, pressing his feet against reaction wall 3 and leaning his back on friction wall 4. Patient 23 presses against auxiliary tool 14 (with bosses 12 attached), while holding handle 11 at arm's length, thereby exerting a strong pressure on his or her back and providing an effective back massage.

Figure 6:
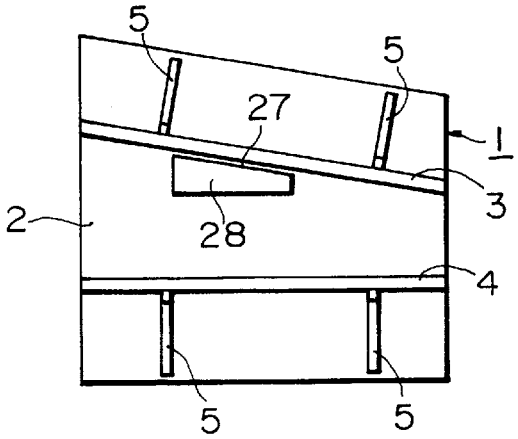
FIG. 6 is a plan view of an embodiment of the foot-pressure massage stand according to the present invention.

Referring now to FIG. 6, an auxiliary tool is composed of a trapezoid-shaped frame member 28. A receiving frame 27 is interposed between trapezoid shaped frame member 28 and reaction wall 3. Each of walls 3, 4 is supported by stays 5 on an outer side. If either of walls 3, 4 is adequately supported or stationary, stays 5 are unnecessary. Both the space and the angle between reaction wall 3 and friction wall 4 may be adjusted. The distance between trapezoid shaped frame member 28 and friction wall 4 can be adjusted by moving trapezoid shaped frame member 28 horizontally along reaction wall 3.

Figure 7:
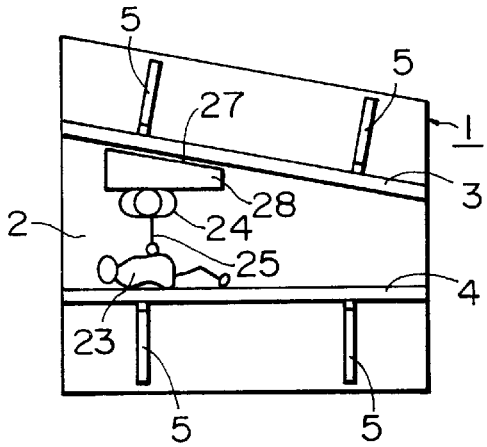
FIG. 7 is a plan view of the foot-pressure massage stand of FIG. 6 used by an operator and patient.

Referring now to FIG. 7, a top view of the method of the present invention is shown. Patient 23 lies sideways against friction wall 4. Operator 24 stands while leaning against reaction wall 3 and stretches a leg 25 in order to directly exert foot pressure upon patient 23. It is noted that patient 23 may also be in other positions, such as lying on his or her stomach or sitting against friction wall 4, as long as the body of patient 23 is stable. The distance between trapezoid shaped frame member 28 and friction wall 4 can be adjusted to accommodate the length of leg 25 of operator 24 by moving trapezoid shaped frame member 28 horizontally along reaction wall 3.

Figure 8:
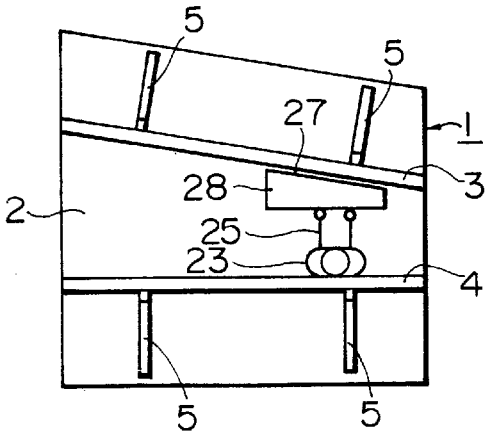
FIG. 8 is a plan view of the foot-pressure massage stand of FIG. 6 used by a patient alone.

Referring now to FIG. 8, patient 23 can massage his or her own back with indirect foot pressure while in a sitting position. Patient 23 leans his or her back against friction wall 4 and presses against trapezoid shaped frame member 28 with his or her leg 25, thereby exerting a strong pressure on his or her back and providing an effective back massage. Receiving frame 27 supports trapezoid shaped frame member 28 and is interposed between reaction wall 3 and trapezoid shaped frame member 28. Each of walls 3, 4 is supported by stays 5 on an outer side. If either of walls 3, 4 is adequately supported or stationary, stays 5 are unnecessary. Both the space and the angle between reaction wall 3 and friction wall 4 may be adjusted. The distance between trapezoid shaped frame member 28 and friction wall 4 can be adjusted to accommodate the length of leg 25 of operator 24 by moving trapezoid shaped frame member 28 horizontally along reaction wall 3.

The present invention can be placed conveniently on a floor of a building or on a stand plate for ease of moving from one location to another. Massage stand 1 can also be placed in a swimming pool for practice of the invention in water. In addition, a side wall of a building can be used as reaction wall 3. If massaging while bathing is desired, a bath tub wall can be used as the reaction wall 3. In each case, the friction wall 4 (with any auxiliary tool attached if desired) is at a distance from reaction wall 3 which corresponds to a length of a leg 25 of operator 24 or patient 23 in order to apply sufficient foot pressure directly or indirectly while massaging. Trapezoid shaped frame member 28 insures that the direction of pressure is imposed to provide effective massage. Trapezoid shaped frame member 28 has a nonskid back made of rubber or other such material in order to prevent the tool from slipping during the massage.

According to the present invention, massage stand 1 makes it possible for operator 24 and patient 23 or patient 23 alone to select an appropriate width between friction wall 4 and reaction wall 3. Friction wall 4 and reaction wall 3 are non-parallel and at a distance that corresponds to a length of a leg 25 of operator 24 or patient 23. One practice of the invention is for operator 24 to lean against reaction wall 3, and to directly apply pressure with his or her foot (feet) to patient 23, who is lying stably against friction wall 4. Another practice of the invention is for patient 23 to massage himself while sitting on floor plate 2, by using various auxiliary tools to massage areas of his or her body such as the back and lateral chests. By exerting foot pressure using massage stand 1, stronger foot pressure can be achieved by than just using body weight or by leaning against only one wall, thereby achieving a more effective massage than the conventional method.

Having described the preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An apparatus for foot-pressure massage comprising:

a reaction wall;

a friction wall;

a stationary floor plate;

said reaction wall and said friction wall affixed to said floor plate and defining first and second planes, respectively;

said second plane is perpendicular to said floor plate;

said reaction wall is angled outward such that said first and second planes are non-parallel and intersect to form an angle of less than 90° and a line of said intersection is parallel to said floor plate;

means for supporting said reaction wall and said friction wall in said nonparallel orientation;

said reaction wall and said friction wall separated by a gap;

means for adjusting a width of said gap by selectively moving one of said reaction and friction walls on said floor plate;

said friction wall capable of resisting pressure applied from a body of a patient receiving a massage;

said reaction wall capable of resisting pressure applied from at least one of a body of an operator and a foot of said patient;

said width of said gap and said angle of said first and second planes effective to permit at least one of said body of said operator and said foot of said patient to contact and exert a reaction force against said reaction wall thereby providing augmented massage pressure to said patient.

2. An apparatus for foot-pressure massage according to claim 1, wherein:

said means for supporting said reaction wall and said friction wall includes a first pair of stays mounted on said stationary floor plate and connected to said friction wall for supporting said friction wall; and a second pair of stays mounted on said stationary floor plate and connected to said reaction wall for supporting said reaction wall.

3. An apparatus for foot-pressure massage according to claim 1, further comprising:

an auxiliary tool including a base plate; and said base plate being removably attached to one of said friction and reaction walls.

4. An apparatus for foot-pressure massage according to claim 3, wherein round bars are arranged in parallel form and attached to said base plate.

5. An apparatus for foot-pressure massage according to claim 3, further comprising:

a plurality of pins on said base plate;

said plurality of pins cooperating with a plurality of attaching holes in one of said friction and reaction walls, whereby rapid installation and removal of said auxiliary tool is enabled.

6. An apparatus for foot-pressure massage according to claim 3, wherein a plurality of half-spherical bosses are formed on said base plate.

7. An apparatus for foot-pressure massage according to claim 1, further comprising:

a support member removably attached to said reaction wall;

a surface of said support member opposed to said friction wall and defining a third plane;

said support member positioned on said reaction wall such that said third plane is parallel to said second plane of said friction wall; and said support member modifies said width of said gap effective to permit at least one of said body of said operator and said foot of said patient to contact and exert a reaction force against said support member thereby providing augmented massage pressure to said patient.

8. An apparatus for foot-pressure massage according to claim 7, wherein a surface of said support member in contact with said reaction wall is covered with a non-skid material to prevent slippage between said support member and said reaction wall.

9. An apparatus for foot-pressure massage according to claim 1, wherein:

said friction wall includes at least one handle attached thereto;

said at least one handle is positioned on said friction wall to permit said patient to grasp said at least one handle; and said at least one handle effective to provide support and resistance for said patient when grasped by said patient, thereby enhancing stability of said body of said patient receiving a foot-pressure massage.

10. An apparatus for foot-pressure massage of a patient comprising:

a reaction wall;

a friction wall;

a stationary floor plate;

said reaction wall and said friction wall affixed perpendicularly to said floor plate and defining first and second planes, respectively;

said first and second planes intersecting to form an angle of less than 90°;

said reaction wall and said friction wall separated by a gap;

means for adjusting at least one of a width of said gap and said angle of said first and second planes by selectively moving one of said reaction and friction walls on said stationary floor plate;

said friction wall capable of resisting pressure applied from a body of a patient receiving a massage;

said reaction wall capable of resisting pressure applied from at least one of a body of an operator and a foot of said patient;

a support member removably attached to said reaction wall;

a surface of said support member opposed to said friction wall and defining a third plane;

said support member positioned on said reaction wall such that said third plane is parallel to said second plane of said friction wall; and said support member modifies said width of said gap effective to permit at least one of said body of said operator and said foot of said patient to contact and exert a reaction force against said support member thereby providing augmented massage pressure to said patient.

11. An apparatus for foot-pressure massage of a patient according to claim 4, wherein a surface of said support member in contact with said reaction wall is covered with a non-skid material to prevent slippage between said support member and said reaction wall.

* * * * *